US007743446B2

(12) United States Patent
Collins

(10) Patent No.: US 7,743,446 B2
(45) **Date of Patent: *Jun. 29, 2010**

(54) COMPOSITE DECK SYSTEM

(75) Inventor: Harry Collins, Columbia, SC (US)

(73) Assignee: Consolidated Systems, Inc., Columbia, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/418,801

(22) Filed: Apr. 6, 2009

(65) Prior Publication Data

US 2009/0193755 A1 Aug. 6, 2009

Related U.S. Application Data

(62) Division of application No. 11/333,839, filed on Jan. 17, 2006, now Pat. No. 7,555,800.

(60) Provisional application No. 60/644,913, filed on Jan. 19, 2005.

(51) Int. Cl.
*E01D 19/12* (2006.01)
*E01D 101/00* (2006.01)

(52) U.S. Cl. ..... 14/73; 14/70; 14/75

(58) Field of Classification Search ..... 14/47, 14/70, 73, 73.1, 75

See application file for complete search history.

(56) References Cited

U.S. PATENT DOCUMENTS

| | | | | |
|---|---|---|---|---|
| 1,198,785 | A | 9/1916 | Simpson | |
| 1,409,251 | A | 3/1922 | Simpson | |
| 1,479,557 | A | 1/1924 | Worley | |
| 4,189,883 | A | 2/1980 | McManus | |
| 4,454,695 | A | 6/1984 | Person | |
| 4,457,115 | A | 7/1984 | Grearson et al. | |
| 4,507,901 | A * | 4/1985 | Carroll | 52/302.3 |
| 4,527,372 | A | 7/1985 | Ryan | |
| 4,592,184 | A | 6/1986 | Person et al. | |
| 4,597,233 | A | 7/1986 | Rongoe, Jr. | |
| 4,653,237 | A | 3/1987 | Taft | |
| 4,662,135 | A | 5/1987 | Tanikawa et al. | |
| 4,700,519 | A | 10/1987 | Person et al. | |
| 4,741,138 | A | 5/1988 | Rongoe, Jr. | |
| 5,454,128 | A * | 10/1995 | Kwon | 14/73 |
| 5,544,464 | A | 8/1996 | Dutil | |
| 5,771,655 | A | 6/1998 | Strickland et al. | |
| 5,941,035 | A | 8/1999 | Purse | |
| 6,112,482 | A | 9/2000 | Wright et al. | |
| 6,293,063 | B2 | 9/2001 | Van Doren | |
| 6,317,915 | B1 * | 11/2001 | Grearson | 14/73 |
| 2006/0016133 | A1 | 1/2006 | Speck | |

(Continued)

*Primary Examiner*—Raymond W Addie
(74) *Attorney, Agent, or Firm*—Michael A. Mann; Nexsen Pruet, LLC

(57) ABSTRACT

A composite a deck system having a deck component and a concrete component. The deck component of the present invention includes deck sections, each having a longitudinally-extending rib with spaced apart sidewalls connected to a top wall. At the opposing ends of the sidewalls can be included side edges or webs having upturned flanges with an opening or openings along the flanges that are dimensioned to facilitate composite action between the deck sections and the concrete. The system includes a first deck section, as described, adjacent to a second deck section, wherein the side edges of the first and second deck sections are in juxtaposed relation. These deck sections can be combined with concrete to form a composite deck.

11 Claims, 7 Drawing Sheets

U.S. PATENT DOCUMENTS

2006/0230697 A1 10/2006 Lupton
2008/0000177 A1 1/2008 Siu
2008/0000178 A1 1/2008 Hsu et al.

* cited by examiner

COMPOSITE DECK SYSTEM

CROSS REFERENCE TO RELATED APPLICATIONS

The present invention is a divisional application of US non-provisional patent application Ser. No. 11/333/839, filed Jan. 17, 2006 now U.S. Pat. No. 7,555,800 which claimed the benefit of priority of U.S. Application No. 60/644,913 filed on Jan. 19, 2005.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

The present invention relates to composite decks.

The use of metal decks or sheets to act compositely with concrete slabs is known. These structures are commonly referred to as "composite decks," and are often used in the construction of floors. Composite decks are more efficient than non-composite decks because they make use of the strength of both the steel and the concrete components, resulting in lighter, more cost-effective floors. Because composite decks are widely used in construction applications, there is a great demand that these components be both structurally sound and economical. Thus, the functionality and durability of composite decks are of utmost significance.

In order to ensure that a composite deck will function properly and will have a long lifespan, the interaction between the concrete and the metal decks or sheets must remain in tact. The less separation that occurs between the metal sheet and the concrete interface, the more stable and stronger the composite deck will be. Accordingly, the "co-action" or "composite action" between the metal deck and the concrete can determine the overall success of the composite deck.

Various means have been employed to enhance composite action between metal decks and concrete. For example, embossments along the metal sheets have been used. Altering the dimension and stiffness of the deck profile has also been used. Additionally, the use of steel wires welded to the web of decks has been used to enhance composite action. The gain of composite action produced by these means, however, is often negated by the loss of flexibility in construction design necessitated by these types of devices. Furthermore, composite action between the deck and the concrete of these devices is not ideal and can still be improved.

Accordingly, there exists a need for a composite deck system that can exhibit improved composite action between the metal deck component and concrete, and that can provide greater overall flexibility in construction applications.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

The present invention includes a composite a deck system having a deck component and a concrete component. The deck component of the present invention includes deck sections, each having a longitudinally-extending rib with spaced apart sidewalls connected to a top wall. At the opposing ends of the sidewalls can be included side edges or webs having upturned flanges with an opening or openings along the flanges that are dimensioned to facilitate composite action between the deck sections and the concrete. As used herein, "composite action" refers to the interaction between the present deck and a layer concrete and is an important feature of the present invention. The system includes a first deck section, as described, adjacent to a second deck section, wherein the side edges of the first and second deck sections are in juxtaposed relation. These deck sections can be combined with a concrete layer to form a composite deck.

A feature of the present invention is the use of a composite deck system that employs deck sections having side edges with upturned flanges in juxtaposed relation, whereby the flanges have an opening or openings dimensioned to achieve composite interaction between the decks and poured-in place concrete. In particular, the deck flanges can include a wide variety of openings, such as notches or perforations. These openings can act in concert with the side edges to achieve enhanced composite action between the decks and the concrete. When the concrete component is added to the deck sections, the openings can create both vertical and horizontal locking with the concrete in relation to the orientation of the decks. With improved compatibility between the decks and the concrete comes greater flexibility in the construction applications employing the composite decks. For example, the composite deck system of the present invention can allow for longer and wider deck spans. Moreover, the strength provided by the composite deck system of the present invention can allow for other structural components, such as columns, to be eliminated and/or spaced further apart. This additional flexibility, therefore, can offer different aesthetic environments. Additionally, with fewer structural components needed, the costs and installation times of construction can be reduced.

Another feature of the present invention includes the use of a deck component having side edges with upturned flanges. This feature can further enhance the vertical locking between the deck sections and the concrete. Furthermore, the upturned flanges can act as a pillar, thereby enhancing the load bearing capacity of the composite deck system. In particular, this feature can provide restraint to the vertical component of the strain differential between the decks and the concrete under the superimposed load condition.

Other features and advantages of the present invention will be apparent to those skilled in the art from a careful reading of the Detailed Disclosure of the Preferred Embodiments presented below and accompanied by the drawings.

DETAILED DESCRIPTION OF THE PREFERRED EMBODIMENTS

Figure 1A:
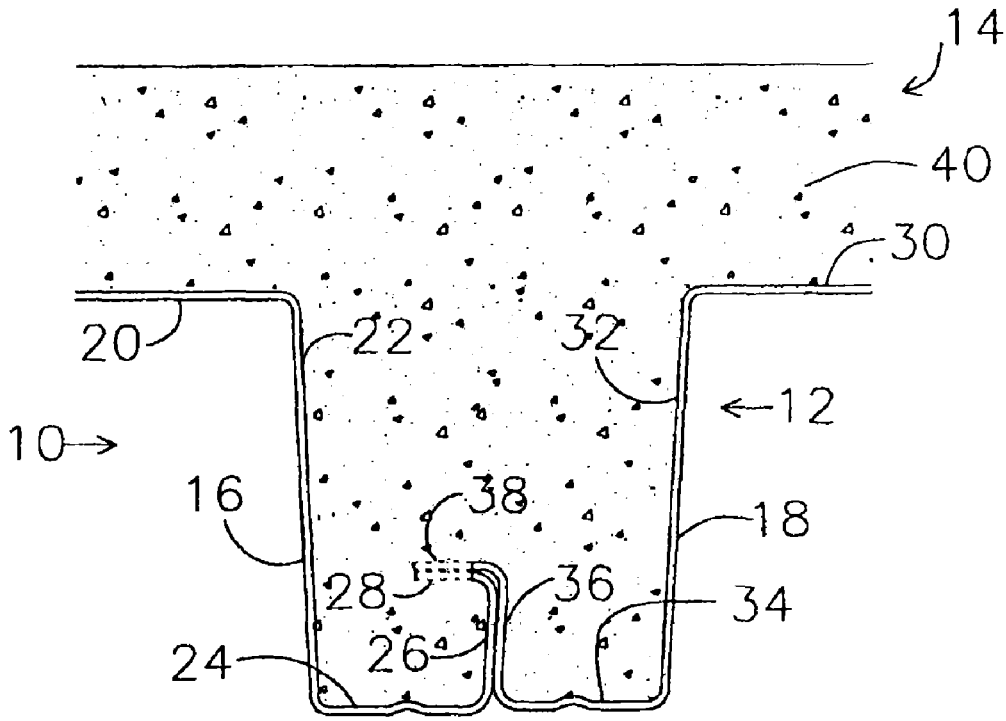
FIG. 1A illustrates a cross-sectional view of deck sections including a concrete component taken at line 1-1 of FIG. 3A of a first embodiment of the composite deck system of the present invention.
Figure 1B:
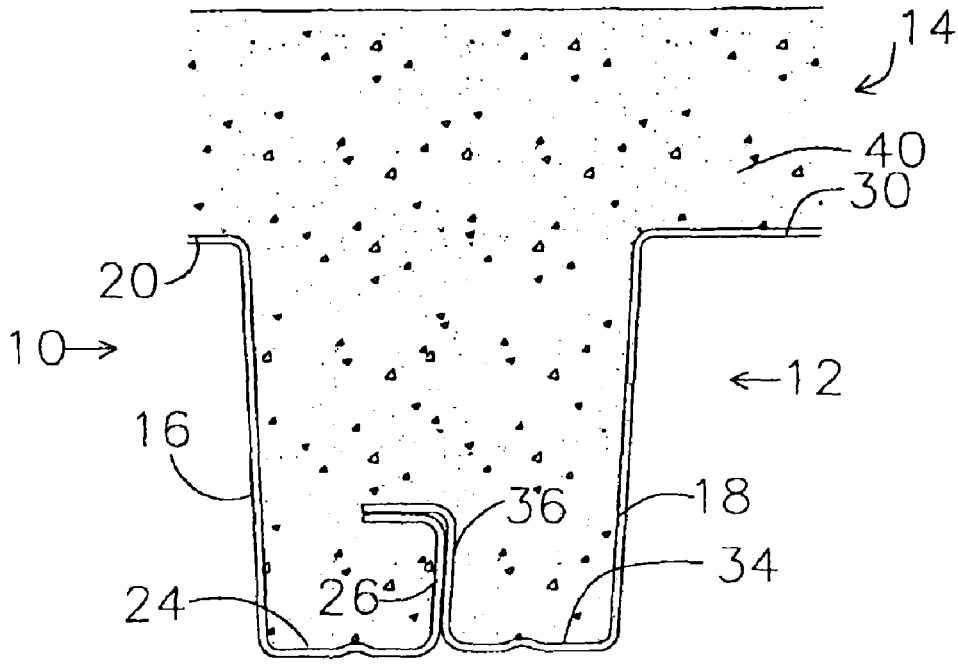
FIG. 1B illustrates a cross-sectional view of deck sections in combination with a concrete component taken at line 2-2 of FIG. 3A of a first embodiment of the composite deck system of the present invention.
Figure 2:
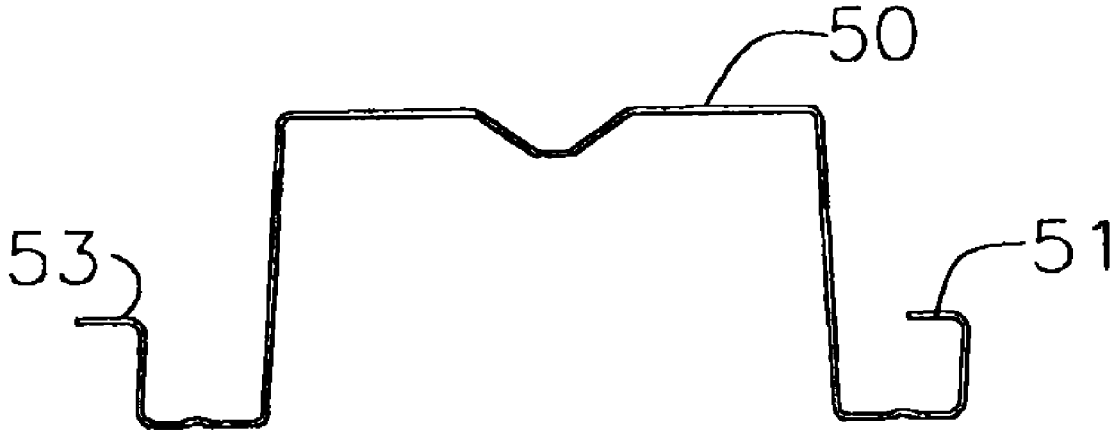
FIG. 2 illustrates an end view of a deck section of a first embodiment of the composite deck system of the present invention.
Figure 3A:
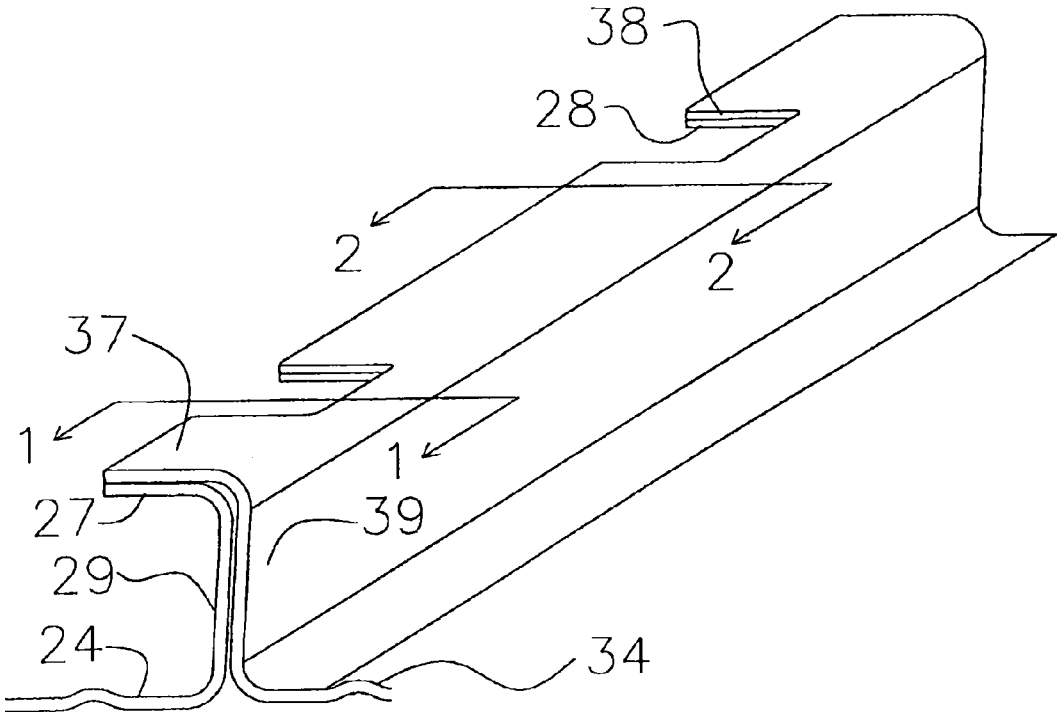
FIG. 3A illustrates a perspective view of adjacent deck sections of a first embodiment of the composite deck system of the present invention.
Figure 3B:
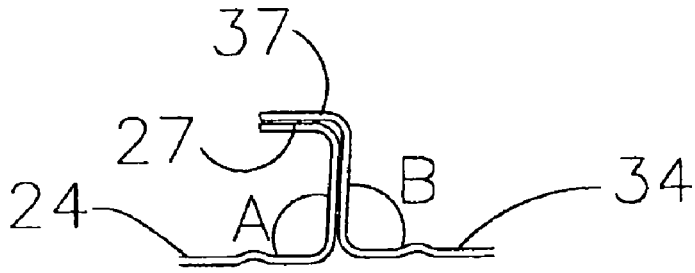
FIG. 3B illustrates an end view of the adjacent deck sections of FIG. 3A of a first embodiment of the composite deck system of the present invention.

As illustrated in FIGS. 1A-1B, the present invention includes a composite deck system 10 including a deck component 12 and a concrete component 14. The deck component 12 can include a first deck section 16 and a second deck section 18 that are adjacent along their longitudinal axes. Additional deck sections can be employed depending on the required span of the composite deck and the dimensions of the deck sections. The decks employed can be made of metal, such as steel. If steel is used, the thickness of the steel will depend on the application of the resulting composite deck. Generally, the first deck section 16 and the second deck section 18 include longitudinally-extending, protruding ribs 50, as shown in FIG. 2. The illustration of the ribs 50 is made merely for completeness to place the deck sections into context; therefore, the shape of the ribs 50 can vary depending on structural and/or aesthetic preferences. Although alternative methods can be employed to construct the composite deck system 10 of the present invention, one method includes pouring the concrete in place after aligning the deck sections 16, 18 and securing the deck sections 16, 18 to a structure, such as load bearing element.

In a first embodiment, the first deck section 16 includes a first top surface 20 connected to a first side wall 22 and a first side edge 24, which is in a plane approximately parallel to the plane of the first top surface 20, and which has a first upturned flange 26 with a first opening 28. The second deck section 18 is approximately identical to the first deck section 16, and includes a second top surface 30 connected to a second side wall 32 and a second side edge 34, which is in a plane approximately parallel to the plane of the second top surface 30, and which has a second upturned flange 36 with a second opening 38 that is in juxtaposed relation to the first upturned flange 26. The concrete component includes a concrete layer 40 that is positioned on the first and second deck sections 16, 18, whereby the concrete layer 40 surrounds the deck sections, including the first and second upturned flanges 26, 36, as shown.

As discussed, a feature of the present invention includes the use of deck sections having side edges with flanges that include an opening or openings. These openings can act in concert with the side edges to achieve enhanced composite action between the deck sections 16, 18 and concrete. Using the first embodiment as an example, when the concrete component 14 is added to the deck sections 16, 18, the openings 28, 38 can create both vertical and horizontal locking with the concrete 40 in relation to the orientation of the decks. In particular, the flanges can distribute the strain interaction in a regular and nearly continuous matter thereby minimizing the end slip phenomenon that is common to many composite deck systems. Further, when the flanges are confined within the concrete 40 thereby stiffening the deck at the point of the interaction, this feature enables the deck to resist the strain to near bearing type capacity.

The interaction between deck sections 16, 18 and concrete component 14 is referred to herein as composite action. The opening 28, 38 allow concrete component 14, when applied to deck sections 16, 18, to flow from one to the other through openings 28, 38 so that, upon curing, concrete component 14 acts in concert with said side edges 24, 34 to lock said deck sections 16, 18 together both vertically and horizontally. Previous decks rely on bolts, pins, crimping and other mechanical fastenings to lock the sections of decking together. Of course, embossments or other surface features have been provided to increase the contact surface area and to create barriers to relative movement between the concrete and the steel decking. However, the use of openings in the steel deck sections that remain open in order to allow the just-poured concrete to flow through from section to section so that, once cured, the concrete grips the metal decking is new and surprisingly effective. Furthermore, this composite action makes a big difference in the design of decking by allowing longer spans and provides a stronger span at less cost than comparably strong spans of the same length.

Using a standard construction software application to compare the load-bearing capacity of a composite steel deck, that is made according to the present claimed composite deck system, and one made with the same steel profile but having a layer concrete on it (a non-composite deck system), the composite deck system had load capacity six times greater than the non-composite deck system.

Moreover, the strength provided by the composite deck system 10 of the present invention can allow for other structural components, such as columns, to be eliminated and/or spaced further apart. This additional flexibility, therefore, can offer different aesthetic environments. Additionally, with fewer structural components needed, the costs and installation times of construction can be reduced.

Another feature of the present invention includes the use of a deck component having side edges with upturned flanges. This feature can further enhance the vertical locking between the deck sections and the concrete. Furthermore, the upturned flanges can act as a pillar, thereby enhancing the load bearing capacity of the composite deck system 10. In particular, this feature can provide restraint to the vertical component of the strain differential between the decks and the concrete 40 under the superimposed load condition.

The particular shapes and dimensions of the first and second upturned flanges 26, 36, as well as the openings along the flanges can vary. Alternative embodiments are shown in FIGS. 3A-11. In the first embodiment, shown in FIGS. 3A-3B, the first and second upturned flanges 26, 36, can be approximately perpendicular to the first and second side edges 24, 34 of the deck sections 16, 18. As further illustrated, the flanges 26, 36 can generally have an inverted L-shape with first and second base member 29, 39 connected to a first and second protruding rim 27, 37, respectively, and can extend longitudinally along the length of the deck sections 16, 18. The plane of the first and second rims 27, 37 is approximately parallel to the plane of the first and second side edges 24, 34. Additionally, the angle A between the first flange 26 and the first side edge 24 is about 90°, and the angle B between the second flange 36 and the second side edge is about 90°. The second flange 36 can be dimensioned to overlap the first flange 26 so that the flanges are juxtaposed. When the composite deck is formed, the deck sections 16, 18 can be aligned so that the first and second flanges 26, 36 are engaged or nested.

Depending on the application of the composite deck system 10, each deck section can include a flange as presently described along one side edge or along both side edges. In the case that the deck section is being used as a central section and will include adjacent deck sections on either side, the deck section can include a flange on both of its side edges, as shown in FIG. 2. Further, if the flanges employ the shape of the first embodiment, the deck section will have a nesting flange 51 along one side edge, and an overlapping flange 53 along the opposing side edge.

In addition to the L-shape, the first and second flanges 26, 36 can also include an opening. As shown, each of the flanges includes an opening 28, 38. In particular, the opening can be a notch that is roughly rectangular in shape and that is included along the edge of the flange rims 27, 37. If both the first and second flanges 26, 36 include an opening, the openings 28, 38 can be approximately the same size and be in approximately the same location, whereby when the first flange 26 and the second flange 36 are aligned, the openings 28, 38 are matched. As used herein, "matched openings" refers to openings that are of about the same shape and dimension and are positioned in about the same location along juxtaposed first and second flanges. Alternatively, there can be one opening along one or both of the first and second flange rims 27, 37, as well as one or both of the first and second base members 29, 39, or there can be a plurality of openings along one or both of the first and second flanges 26, 36, as well as one or both of the first and second base members 29, 39.

Figure 4A:
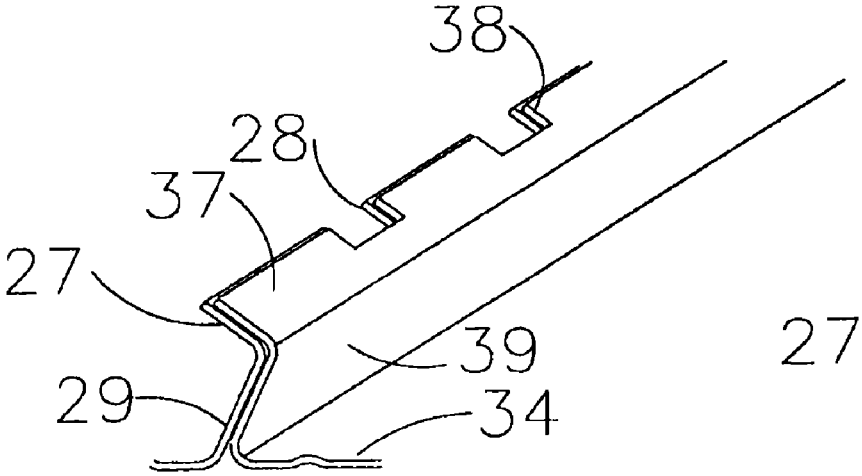
FIG. 4A illustrates a perspective view of adjacent deck sections of an alternative embodiment of the composite deck system of the present invention.
Figure 4B:
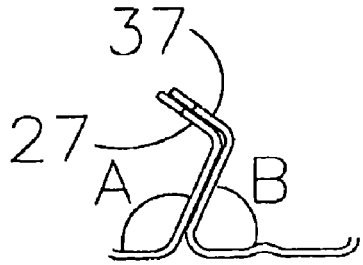
FIG. 4B illustrates an end view of the adjacent deck sections of FIG. 4A of an alternative embodiment of the composite deck system of the present invention.

In an alternative embodiment shown in FIGS. 4A-4B, the first and second flanges 26, 36 are shaped similarly to the flanges of the first embodiment, except that the first and second flanges 26, 36 are at different angles with relation to the side edges 24, 34. In particular, angle A between the first flange 26 and the first side edge 24 is greater than about 90°, and the angle B between the second flange 36 and the second side edge 34 is less than about 90°. Additionally, because the angles of the flanges are distinct, the planes of the first and second rims 27, 37 are no longer parallel with the plane of the first and second side edges 24, 34, and are in stead an angle to the planes of the first and second side edges 24, 34. Alternatively, there can be one opening along one or both of the first and second flange rims 27, 37, as well as one or both of the first and second base members 29, 39, or there can be a plurality of openings along one or both of the first and second flanges 26, 36, as well as one or both of the first and second base members 29, 39.

Figure 5A:
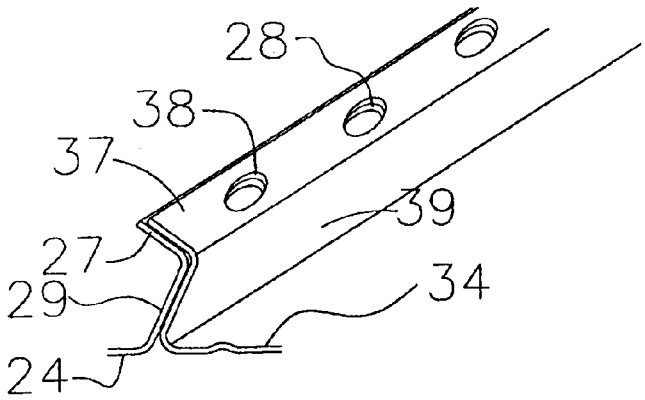
FIG. 5A illustrates a perspective view of adjacent deck sections of an alternative embodiment of the composite deck system of the present invention.
Figure 5B:
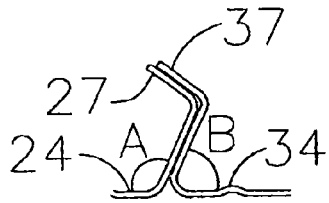
FIG. 5B illustrates an end view of the adjacent deck sections of FIG. 5A of an alternative embodiment of the composite deck system of the present invention.

FIGS. 5A-5B illustrate another alternative embodiment. As shown, the flanges 26, 36 of this embodiment are similar to the embodiment of FIGS. 4A-4B, except that the openings 28, 38 are not notches along the edges of the flange rims 27, 37, but rather are openings within the flange rims 27, 37 that can be circular in shape. Again, angle A between the first flange 26 and the first side edge 24 is greater than about 90°, and the angle B between the second flange 36 and the second side edge is less than about 90°. Alternatively, there can be one opening along one or both of the first and second flange rims 27, 37, as well as one or both of the first and second base members 29, 39, or there can be a plurality of openings along one or both of the first and second flanges 26, 36, as well as one or both of the first and second base members 29, 39.

Figure 6:
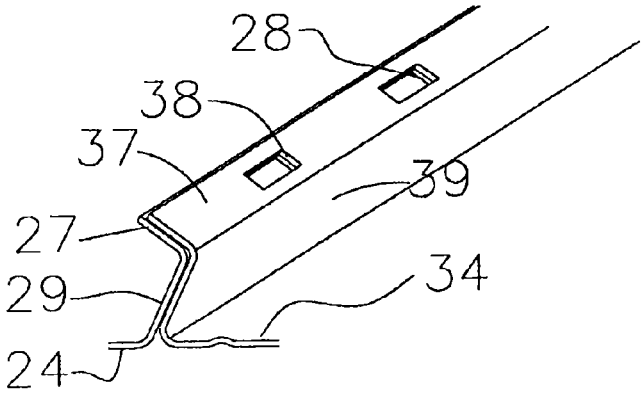
FIG. 6 illustrates a perspective view of adjacent deck sections of an alternative embodiment of the composite deck system of the present invention.

Yet another alternative embodiment is illustrated in FIG. 6. As shown, the flanges 26, 36 are similar to the embodiment described in FIGS. 5A-5B, except the shape of the openings 28, 38 can be rectangular. Alternatively, there can be one opening along one or both of the first and second flange rims 27, 37, as well as one or both of the first and second base members 29, 39, or there can be a plurality of openings along one or both of the first and second flanges 26, 36, as well as one or both of the first and second base members 29, 39.

Figure 7:
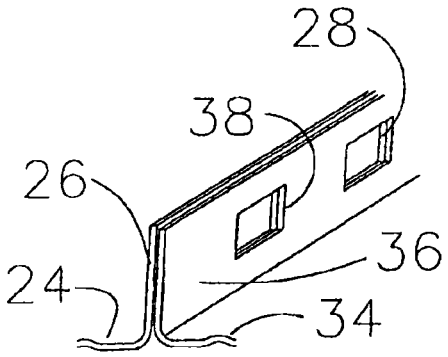
FIG. 7 illustrates a perspective view of adjacent deck sections of an alternative embodiment of the composite deck system of the present invention.
Figure 9:
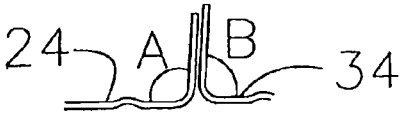
FIG. 9 illustrates an end view of adjacent deck sections of an alternative embodiment of the composite deck system of the present invention.

FIG. 7 illustrates an alternative embodiment that is distinct from the embodiment previously described in that the flanges 26, 36 do not include a first and second flap 27, 37 along their respective top edges. Accordingly, there is no overlap of the second flange 34 onto the first flange 24, and each flange is generally upturned at about 90°, as shown in FIG. 9. Moreover, the openings 28, 38 can be included along what were previously referred to as base members 29, 39. In particular, the openings can be rectangular shaped. Alternatively, there can be one opening along one or both of the first and second base members 29, 39, or there can be a plurality of openings along one or both of the first and second base members 29, 39.

Figure 8:
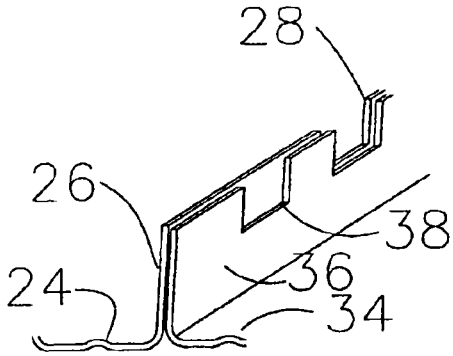
FIG. 8 illustrates a perspective view of adjacent deck sections of an alternative embodiment of the composite deck system of the present invention.
Figure 10:
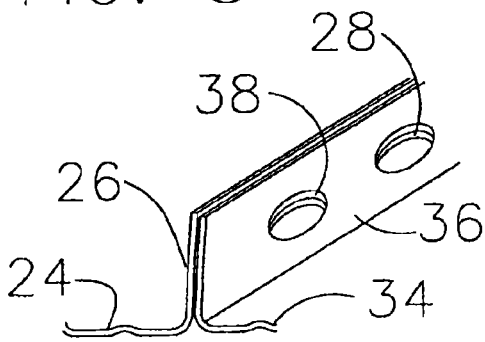
FIG. 10 illustrates a perspective view of adjacent deck sections of an alternative embodiment of the composite deck system of the present invention.

FIGS. 8 and 10 illustrate alternative embodiments that are similar to that of FIG. 7. In particular, the flanges 26, 36 shown in FIG. 10 are similar to those described and shown in FIG. 7, except the openings 28, 38 are circular in shape. The openings 28, 38 shown in FIG. 8, on the other hand, are notches along the respective top edges of the first and second flanges 26, 36. Furthermore, the positioning of the openings along the first flange 26 does not have to match the openings of the second flange. As shown in FIG. 8, opening 38 is eclipsed by flange 26.

Figure 11:
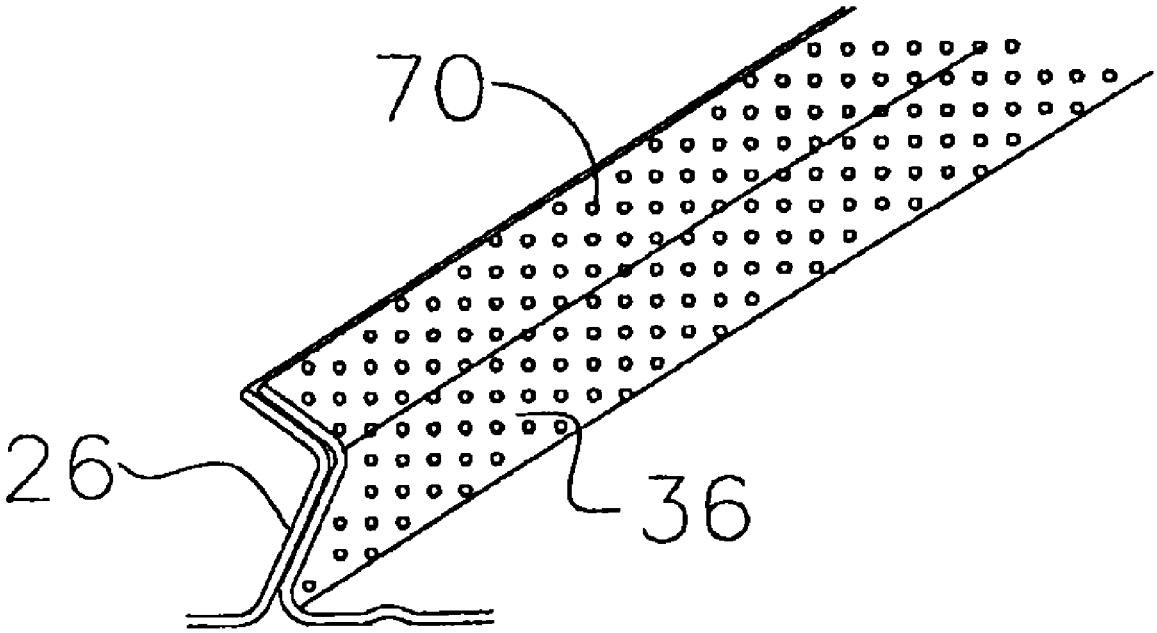
FIG. 11 illustrates a perspective view of adjacent deck sections of an alternative embodiment of the composite deck systems of the present invention.

Although particular shapes and positions have been described and shown with respect to the openings 28, 38, any geometric shape can be employed along any area of the flanges 26, 36. Furthermore, the frequency of openings along the flanges can also be varied. For example, the flanges 26, 36 can be perforated throughout so as to provide a polka-dot type pattern 70, as shown in FIG. 11. Additionally, it should be understood that the deck section shown in FIG. 2 can include any of the alternative flange embodiment as described, and does not necessarily need to include a nesting flange and an overlapping flange.

Those skilled in the art of composite decks will recognize that many substitutions and modifications can be made in the foregoing preferred embodiment with departing from the spirit and scope of the present invention.

What is claimed is:

1. A composite deck system, comprising:

a first deck section having a first side wall connected to a first top surface, said first side wall including a first side edge having a first upturned flange, wherein said first upturned flange includes a first opening;

a second deck section adjacent to said first deck section having a second sidewall connected to a second top surface, said second side wall including a second side edge with a second upturned flange, wherein said second upturned flange is adjacent to said first upturned flange, and wherein said second upturned flange includes a second opening; and a concrete layer positioned on said first top surface and said second top surface and surrounding said first upturned flange and said second upturned flange, where said first and said second openings allow said concrete layer to flow between said first deck section and said second deck section through said first and second openings so that, upon curing, said concrete layer acts in concert with said first and said second side edges to lock said first and said second deck sections together vertically and horizontally.

2. The composite deck system as recited in claim 1, wherein said first opening and said second opening are circular.

3. The composite deck system as recited in claim 1, wherein said first opening and said second opening are rectangular.

4. The composite deck system as recited in claim 1, wherein said first opening and said second opening are formed in a geometrical shape.

5. The composite deck system as recited in claim 1, wherein said first upturned flange and said second upturned flange are perforated.

6. The composite deck system as recited in claim 1, wherein the plane of said first rim and the plane of said second rim are each about parallel with the plane of said first side edge and the plane of said second side edge, respectively, wherein the angle A between said first base member and said first side edge is about 90°, and wherein the angle B between said second base member and said second side edge is about 90°.

7. The composite deck system as recited in claim 1, wherein the plane of said first rim and the plane of said second rim are each at an angle with the plane of said first side edge and the plane of said second side edge, respectively, wherein the angle A between said first base member and said first side edge is greater than about 90°, and wherein the angle B between said second base member and said second side edge is less than about 90°.

8. The composite deck system as recited in claim 1, wherein said first upturned flange is a nesting flange, and wherein said second upturned flange is an overlapping flange.

9. The composite deck system as recited in claim 8, wherein said first upturned flange includes a first base member connected to a first rim, and wherein said second upturned flange includes a second base member connected to a second rim.

10. The composite deck system as recited in claim 9, wherein said first and second openings are notches formed along said first rim and said second rim, respectively.

11. A composite deck system, comprising:

a first deck section having a first side wall connected to a first top surface, said first side wall including a first side edge having a first upturned flange, wherein said first upturned flange includes a first base that is about perpendicular to said first side edge, and wherein said first base includes a first opening;

a second deck section adjacent to said first deck section having a second side wall connected to a second top surface, said second side wall including a second side edge with a second upturned flange, wherein said second upturned flange is adjacent to said first upturned flange, wherein said second upturned flange includes a second base that is about perpendicular to said second side edge, and wherein said second base includes a second opening; and a concrete layer positioned on said first top surface and said second top surface and surrounding said first upturned flange and said second upturned flange, wherein said first and said openings remaining open to provide communication between said first and said second deck sections so that said concrete layer will extend from said first and said second deck sections through said first and second openings, and, upon curing, act in concert with said first and said second side edges to lock said first and said second deck sections together both vertically and horizontally.

* * * * *